United States Patent [19]

Bekius et al.

[11] Patent Number: 4,884,742

[45] Date of Patent: Dec. 5, 1989

[54] FLAT TIP FOR CUP GUNS

[75] Inventors: Wayne Bekius, Milaca; John Svendsen, Corcoran, both of Minn.

[73] Assignee: Wagner Spray Tech Corporation, Minneapolis, Minn.

[21] Appl. No.: 232,950

[22] Filed: Aug. 16, 1988

[51] Int. Cl.[4] ..... B05B 15/08

[52] U.S. Cl. ..... 239/71; 239/288; 239/600

[58] Field of Search ..... 239/288, 288.3, 288.5, 239/599, 600, DIG. 22, 71

[56] References Cited

U.S. PATENT DOCUMENTS

| | | | |
|---|---|---|---|
| 2,125,445 | 8/1938 | Holveck | 239/599 |
| 2,985,386 | 5/1961 | Steinen | 239/601 |
| 3,045,932 | 7/1962 | Steinen | 239/601 |
| 3,101,906 | 8/1963 | Webber | 239/601 |
| 3,398,899 | 8/1968 | Fry | 239/601 |
| 3,416,736 | 12/1968 | Marik | 239/597 |
| 3,713,591 | 1/1973 | Watkins | 239/597 |
| 3,952,955 | 4/1976 | Clements | 239/599 |
| 3,963,180 | 6/1976 | Wagner | 239/288.5 |
| 4,025,045 | 5/1977 | Kubiak | 239/599 |
| 4,103,830 | 8/1978 | Roth | 239/599 |
| 4,141,503 | 2/1979 | Beck | 239/394 |
| 4,181,261 | 1/1980 | Crum | 239/288.5 |
| 4,239,157 | 12/1980 | Fasth | 239/599 |
| 4,349,947 | 9/1982 | Rood | 239/599 |

*Primary Examiner*—Andres Kashnikow
*Assistant Examiner*—Karen B. Merritt
*Attorney, Agent, or Firm*—Hill, Van Santen, Steadman & Simpson

[57] ABSTRACT

A nozzle assembly for being received on an end of a spray gun is provided in which there is a nozzle holder member having a through passage which is engageable with an end of the spray gun and which carries a nozzle member rotatingly therein, the nozzle member including a non-circular orifice. An actuating lever engages the nozzle member and has a manual engagement area graspable by a user such that the nozzle orifice can be rotated within the nozzle holder member upon rotation of the actuating lever. The actuating lever provides a visual indicator of the position of the nozzle orifice.

12 Claims, 1 Drawing Sheet

FLAT TIP FOR CUP GUNS

BACKGROUND OF THE INVENTION

The present invention relates to airless paint spray guns and more particularly to a flat tip nozzle for such guns.

Flat tip nozzles have been used in connection with airless paint spraying equipment as evidenced by U.S. Pat. No. 4,025,045 assigned to the assignee of the present application. As disclosed in that patent, a discharge end of the spray pistol includes a tip nut which is threadingly received on the gun and which engages over a flange of a guard member which in turn has means for engaging a flange of a nozzle tip. Thus, the nozzle tip which includes a non-circular orifice can be firmly held on the front of the spray gun to direct a relatively flat spray. The ledge on the outer diameter of the tip nut is generated as a circle which allows complete rotation of the guard member with respect to the tip nut. However, the inner diameter of the guard member which abuts the outer diameter of the nozzle tip has diametrically opposed flats thereon which mate with flats on the nozzle tip. In this manner, the nozzle tip is not rotatable independently of the guard member. This is desireable in the structure disclosed in the '045 patent in that the guard member has a slotted opening permits the fan of the spray to exit through the slots as well as the front opening of the guard and thus the slots must always be maintained in alignment with the major axis of the orifice opening.

U.S. Pat. No. 3,952,955 to Clements also discloses a safety tip guard for an airless paint spray gun having a slotted orifice. In this construction there is a tip retainer nut which is threadingly received on the gun and which axially retains a tip holder. The safety guard is formed by two spaced apart arms which fan out away from each other and thus define a slotted type opening therebetween. The major axis of the orifice is maintained in alignment with the slot of the guard by mating flat surfaces between the spray tip and the guard. The guard itself is rotatable on the tip retainer nut by means of a spring expansion ring which fits within the guard and over the tip retainer nut. Once the spray orifice is rotated to a desired position, the retainer nut is tightened with a wrench to secure the orifice in a fixed position.

SUMMARY OF THE INVENTION

The present invention provides a spray tip arrangement for a spray gun such as a cup gun wherein the guard is formed as a part of the retaining nut and the nozzle member is rotatably carried in the nut portion of the guard. An actuating lever is secured to the nozzle which extends along the interior of the guard and projects out from the guard to permit the nozzle to be rotated before the guard and retaining nut are secured in place. An end of the actuating member which extends outside of the guard provides both a manual grasping area for rotating the nozzle which is outside of the cone of spray of paint from the spray gun as well as providing an indicator for the orientation of the major axis of the nozzle orifice. Thus, with a nozzle arrangement constructed in accordance with the present invention, the nozzle member may be rotated to any desired orientation and a visual indicator of the orientation is present. A conical guard member is provided which accomodates a flat spray pattern in any rotational orientation of the nozzle orifice.

DESCRIPTION OF THE PREFERED EMBODIMENTS

Figure 1:
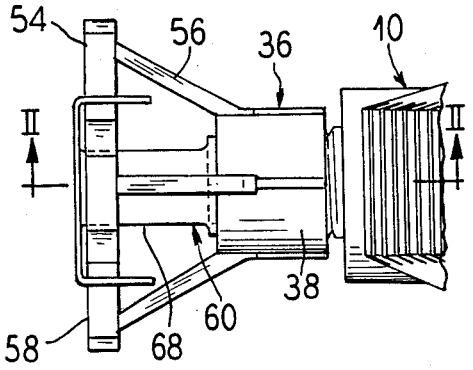
FIG. 1 is a partial top view of a cup gun in the area of the spray nozzle and safety shield.
Figure 2:
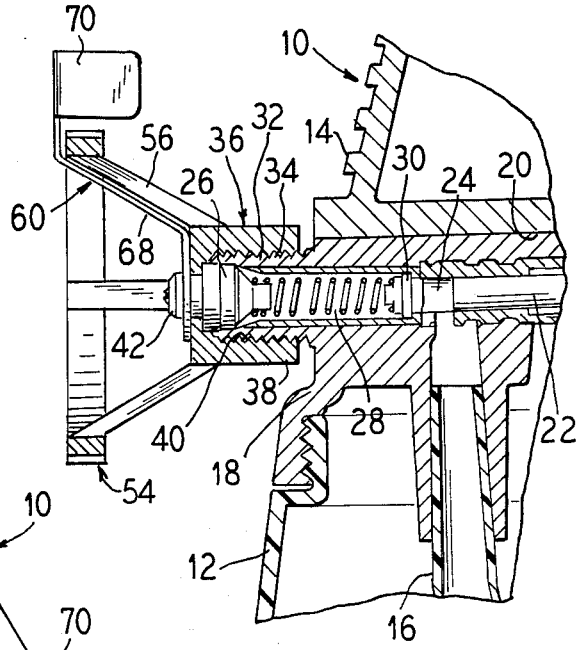
FIG. 2 is a side sectional view taken generally along the line II—II of FIG. 1.
Figure 3:
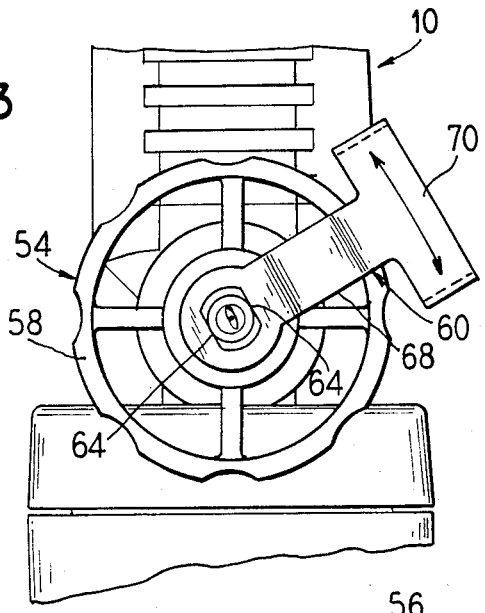
FIG. 3 is a front elevational view of the nozzle area of the cup gun of FIG. 1.
Figure 4:
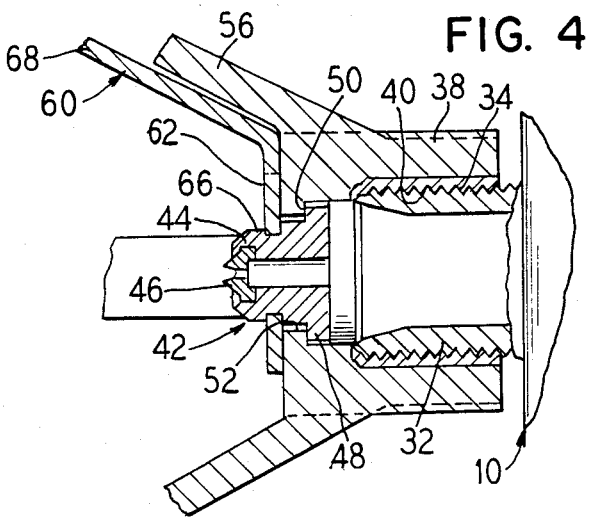
FIG. 4 is an enlarged partial sectional view of the nozzle area of the cup gun of FIG. 2.

In FIGS. 1-4 there is partially illustrated an airless paint spray cup gun, generally at 10 which may be of the type disclosed in U.S. Pat. No. 3,899,134. A supply container 12 is removably suspended from a housing 14 of the spray gun and feeds liquids, such as paint, through a suction tube 16 suspended from a cover or lid 18 for the container 12. The lid 18 is a portion of a one-piece injection molded plastics material or die cast metal parts suspended from a bore 20 of the gun housing 14. A piston 22 is slidably mounted within the cover 18 and a pumping chamber 24 is provided ahead of the piston 22. An outlet valve 26 is slidable within a chamber 28 of the cover 18 and is seated at a rearward end 30 just forward of the pumping chamber 24.

The cover 18 has a forwardly extending cylindrical projection 32 with an external thread 34 which surrounds the chamber 28 carrying the outlet valve 26. A nozzle assembly 36 has a rearward nut portion 38 having an internal thread 40 which threadingly mates with the external threads 34 of the cover projection 32.

A spray nozzle 42 comprising an outer sleeve member 44 and a nozzle orifice member 46 are rotatably carried in the nozzle assembly 36 by means of a flange 48 on the nozzle sleeve mating with an internal step 50 formed at a forward end of the retaining nut portion 38 of the nozzle assembly. The nozzle sleeve 44 projects through an opening 52 in the retaining nut portion 38, the opening 52 being larger than the sleeve 44 so as to permit rotation therebetween.

The nozzle assembly includes a projecting safety barrier 54 which may be similar to that disclosed in U.S. Pat. No. 4,036,438 and which comprises a plurality of spokes 56 and an annular ring member 58 which is positioned forwardly of the nozzle orifice. The spokes 56 angle outwardly to form a truncated cone shape.

An actuating lever 60 is provided to permit rotation of the nozzle 42 within the nozzle assembly. The actuating lever 60 has a first end 62 which surrounds a projecting portion of the nozzle sleeve 44 and is keyed to the nozzle sleeve by a pair of flats 64 formed both on the nozzle sleeve 44 and in the actuating lever 60. The end 62 of the actuating lever is held axially on the sleeve by means of a lip 66 formed on the sleeve which captures a portion of the surrounding end 62 of the actuating lever. Thus, the nozzle 42 is held the forward end of the retaining nut portion 38 due to the flange 48 and step 50 engagement at one end and the surrounding end 62 engagement at the opposite end.

The actuating lever 60 includes an angled extending arm 68 which conforms to the outward angle of the spokes 56 of the barrier 54 and includes a manual engaging portion 70 which extends outside of the barrier ring 58 to permit manual grasping and rotation of the nozzle orifice from a location outside of the cone of spray.

Thus, the nozzle orifice may be rotated by a loosening of the safety barrier and the end of the acutating lever which extends outside of the barrier ring provides a visual indication of the orientation of the orifice. Since the actuating lever is keyed to the spray nozzle, the end 70 will always remain in a fixed position relative to the major axis of the nozzle orifice.

Therefore, the present invention provides a nozzle assembly for being received on an end of a gun which comprises a nozzle holder member which includes the nut portion 38 of the nozzle assembly as well as the safety barrier 54. This nozzle holder member has a through passage with one end being engagingly matable with an end of the spray gun, such as by an internal thread in the nut which mates with the external threads of the spray gun cover. A second end of the passage includes an opening in which is received the nozzle member comprising the outer sleeve member and the nozzle orifice member. The nozzle member has a generally cylindrical body sized to be rotatingly held within the opening in the nozzle holder member. Further, an actuating lever having a first end which engages the nozzle member and the second end which comprises a manual engagement area graspable by a user is provided such that the nozzle orifice can be rotated within the nozzle guard member upon rotation of the actuating lever.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

We claim as our invention:

1. A nozzle assembly for being received on an end of spray gun comprising:

a nozzle guard member having a through passage, one end of said nozzle guard member being engagingly matable with said end of said spray gun and an opposite end of said nozzle guard member including an opening to said passage;

a nozzle member, including a non-circular orifice, having a generally cylindrical body sized to be rotatingly held within said opening in said nozzle guard member, said cylindrical body having a length sufficient so as to project beyond said opening; and an actuating lever having a first end which engages said nozzle member where it projects beyond said opening, and a second end which comprises a manual engagement area graspable by a user, such that said nozzle orifice can be rotated within said nozzle guard member upon rotation of said actuating lever.

2. A nozzle assembly according to claim 1, wherein said passage has an internal step adjacent said opening such that said opening has a diameter less than a diameter of said passage, and said nozzle member has an annular flange at one end engagable with said step to provide said rotational holding of said nozzle member in said nozzle guard member.

3. A nozzle assembly according to claim 1, wherein said nozzle guard member comprises a projecting barrier portion and an integrated retaining nut portion.

4. A nozzle assembly according to claim 3, wherein said second end of said actuating lever extends beyond said projecting barrier portion.

5. A nozzle assembly according to claim 3, wherein said projecting barrier portion has a conical shape.

6. A nozzle assembly for being received on a threaded end of an airless paint spray gun comprising: a nozzle guard member comprising a projecting barrier and an integral retaining nut;

said retaining nut having a through passage, one end of said passage being internally threaded so as to engagingly mate with said threaded end of said spray gun and an opposite end of said passage forming an opening of a diameter less than a diameter of said passage, said smaller diameter being formed by an internal annular step;

a nozzle member comprising a nozzle sleeve member and a nozzle orifice member, said nozzle sleeve member having a generally cylindrical body sized to rotatingly fit within said opening in said retaining nut and having a flange at one end to engage said annular step, said cylindrical body having a length sufficient so as to project beyond said opening; and an actuating lever having a first end which engagingly surrounds said nozzle sleeve member where it projects beyond said opening, and a second end which comprises a manual engagement area graspable by a user, such that said nozzle orifice can be rotated within said retaining nut upon rotation of said actuating lever.

7. A nozzle assembly according to claim 6, wherein said nozzle orifice member is press fit into said nozzle sleeve 8. A nozzle assembly according to claim 6, wherein said second end of said actuating lever extends beyond said projecting barrier portion.

9. A nozzle assembly according to claim 6, wherein said projecting barrier portion has a conical shape.

10. A nozzle assembly for being received on an end of spray gun comprising:

a nozzle holder member having a through passage, a first end of said nozzle holder member being engagingly matable with said end of said spray gun and a second end of said holder member including an opening to said passage;

said nozzle holder member comprising a projecting barrier portion and an integrated retaining nut portion;

a nozzle member, including a non-circular orifice, having a generally cylindrical body sized to be rotatingly held within said opening in said nozzle holder member; and an actuating lever having a first end which engages said nozzle member, and a second end which comprises a manual engagement area graspable by a user, such that said nozzle orifice can be rotated within said nozzle holder member upon rotation of said actuating lever.

11. A nozzle assembly according to claim 10, wherein said nozzle holder member has an internal thread at said first end to threadingly engage said end of said spray gun.

12. A nozzle assembly according to claim 10, wherein said actuating lever includes a visual indicator means for indicating the orientation of said non-circular orifice.

* * * * *